US008152474B2

(12) United States Patent
Hwang et al.

(10) Patent No.: US 8,152,474 B2
(45) Date of Patent: Apr. 10, 2012

(54) COOLING FAN IMPELLER

(75) Inventors: Ching-Bai Hwang, Tu-Cheng (TW); Zhi-Hui Zhao, Shenzhen (CN); Ran Lin, Shenzhen (CN)

(73) Assignees: Furui Precise Component (Kunshan) Co., Ltd., KunShan, Jiangsu Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 474 days.

(21) Appl. No.: 12/417,650

(22) Filed: Apr. 3, 2009

(65) Prior Publication Data

US 2009/0257883 A1 Oct. 15, 2009

(30) Foreign Application Priority Data

Apr. 11, 2008 (CN) ..... 2008 1 0066579

(51) Int. Cl.

| | |
|---|---|
| ***B63H 1/26*** | (2006.01) |
| ***B63H 7/02*** | (2006.01) |
| ***B64C 11/24*** | (2006.01) |
| ***B64C 27/46*** | (2006.01) |

(52) U.S. Cl. ..... 416/243; 416/223 R; 426/179; 426/238; 426/228; 426/223 B

(58) Field of Classification Search ..... 416/243, 416/203, 223 R; 426/238, 179, 223 B, 228
See application file for complete search history.

(56) References Cited

U.S. PATENT DOCUMENTS

| | | | | |
|---|---|---|---|---|
| 3,581,663 | A * | 6/1971 | Lohman | 102/225 |
| 6,827,555 | B2 * | 12/2004 | Yang | 416/197 R |
| D532,903 | S * | 11/2006 | Hirata et al. | D23/413 |

FOREIGN PATENT DOCUMENTS

| | | | |
|---|---|---|---|
| CN | 2761887 | Y | 3/2006 |
| CN | 1804755 | A | 7/2006 |
| JP | 200670808 | A | 3/2006 |

* cited by examiner

*Primary Examiner* — David Nhu
(74) *Attorney, Agent, or Firm* — Altis Law Group, Inc.

(57) ABSTRACT

An impeller of a centrifugal fan includes a hub and a plurality of blades arranged on and around the hub. Each of the blades includes a root portion and a tip portion. The tip portion of each of the blades has a concave surface and a convex surface in rear and front sides thereof respectively. In a rotational direction of the impeller, the tip portion of a rear blade protrudes towards a front blade.

17 Claims, 7 Drawing Sheets

COOLING FAN IMPELLER

BACKGROUND

1. Technical Field

The disclosure relates to cooling fans, and particularly relates to an impeller of a centrifugal fan cooling heated electronic components.

2. Description of Related Art

With continuing developments in technology, electronic components such as CPUs generate considerable heat that must be dissipated immediately. A centrifugal fan is conventionally secured beside the heated CPU, producing cooling airflow to dissipate the heat from the CPU. An impeller of the centrifugal fan for such an application consists of a hub and plural flat blades. The flat blades extend radially from the hub, driving air to generate airflow when the impeller rotates. However, in a notebook computer, limited available space restricts the allowable size of the impeller blades, limiting heat dissipation capability accordingly.

What is needed, therefore, is an impeller for a centrifugal fan addressing the limitations described.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
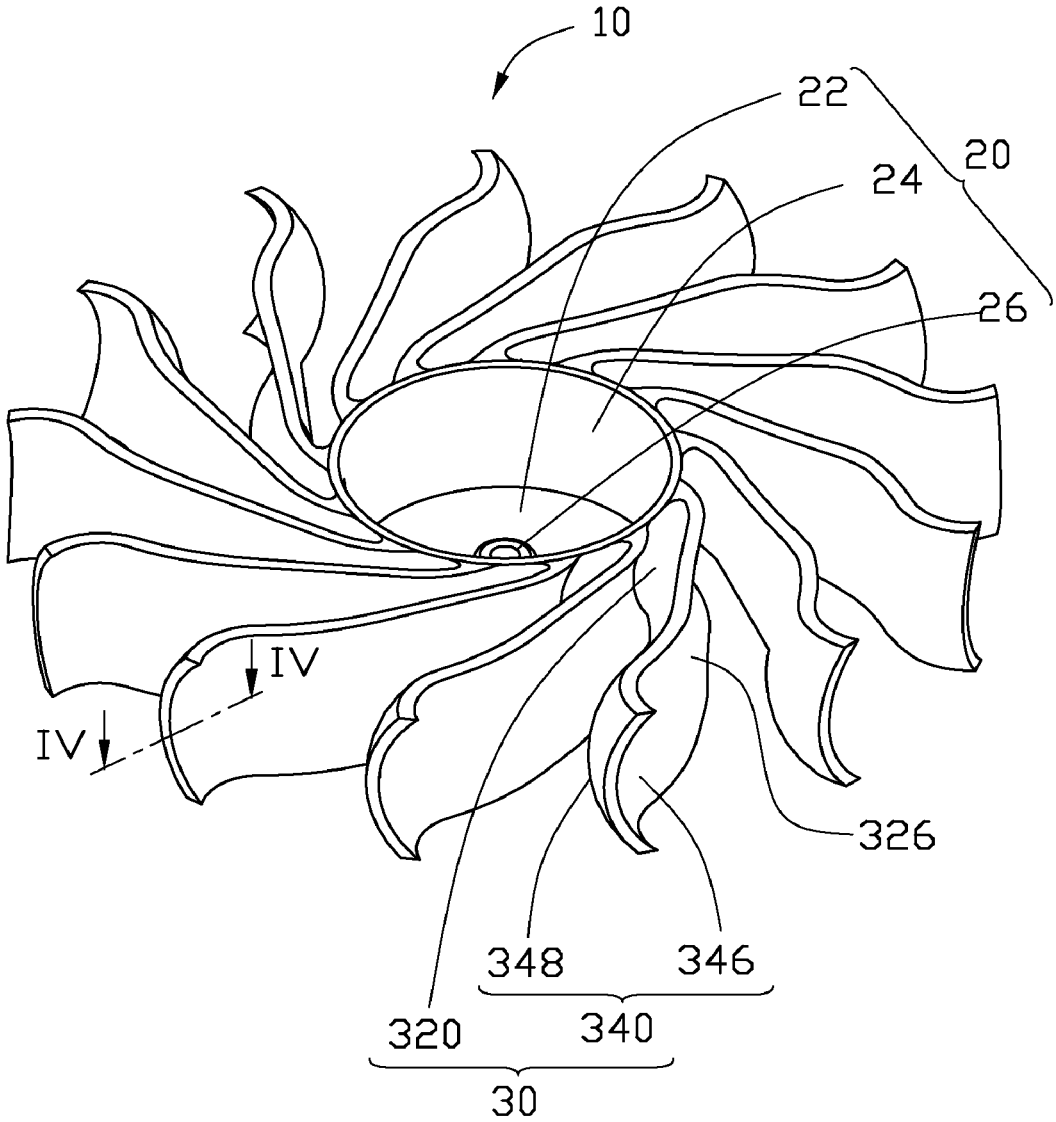
FIG. 1 is an isometric view of an impeller in accordance with a first embodiment.

Referring to FIG. 1, an impeller 10 used in a centrifugal fan according to a first embodiment includes a hub 20, and a plurality of blades 30 arranged on and around the hub 20.

The hub 20 includes a circular bottom plate 22 and a peripheral wall 24 extending upwardly from a border thereof. A hollow, cylindrical protrusion 26 extends upwardly from a central portion of the bottom plate 22, seating a rotary shaft (not shown) of the centrifugal fan mounted thereon.

Figure 2:
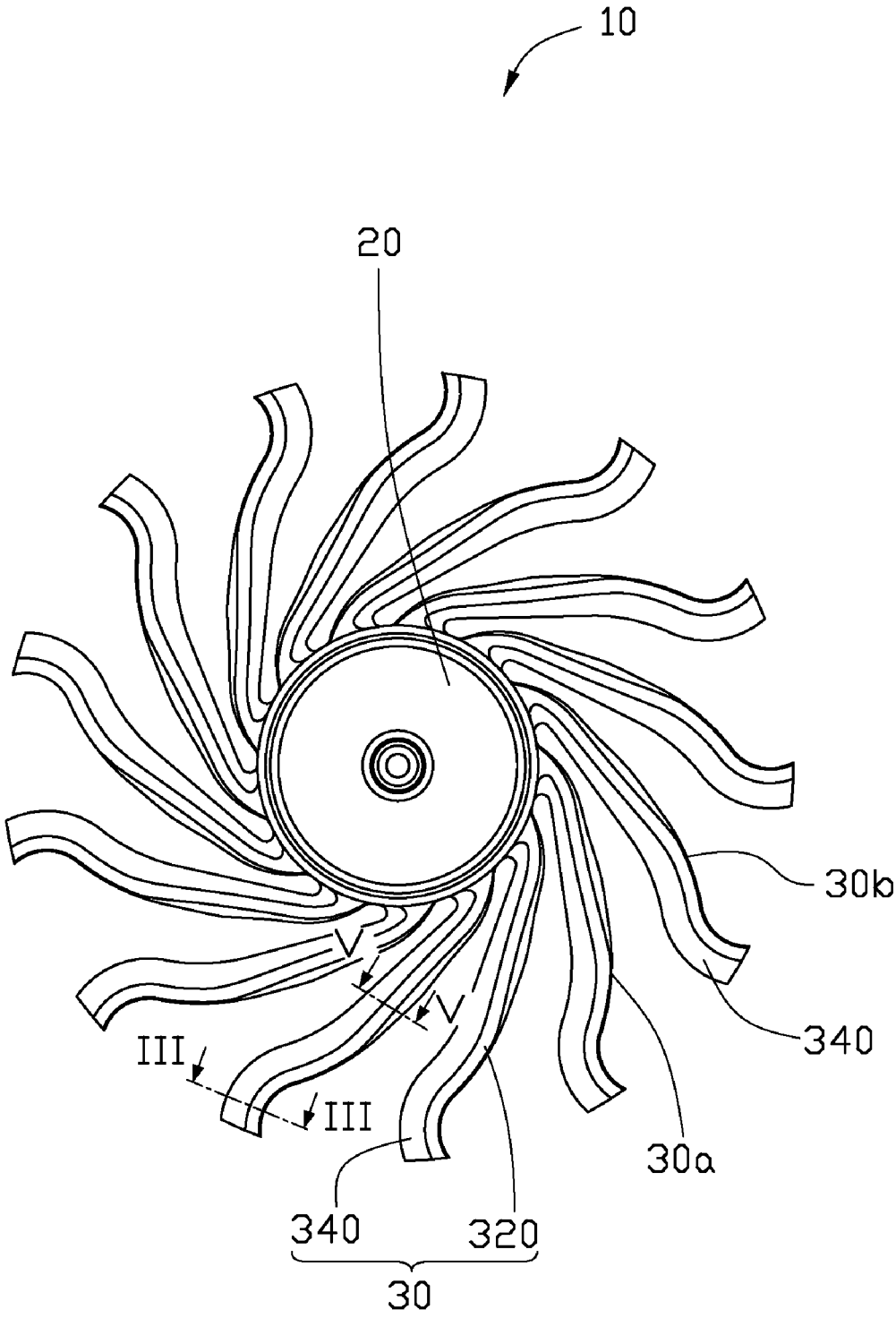
FIG. 2 is a top plan view of the impeller of FIG. 1.

Also referring to FIG. 2, the blades 30 extend radially from an outer, circumferential surface of the peripheral wall 24 of the hub 20. The blades 30 are evenly arranged around the hub 20.

The blades 30 of the impeller 10 are all the same shape. Each blade 30 has a root portion 320 and a tip portion 340. The root portion 320 connects with the hub 20 and the tip portion 340 forms the free end of the blade 30. The root portion 320 and the tip portion 340 are the same height. The root portion 320 has a longer extended length than the tip portion 340. Each blade 30 is spoon-shaped, with root portion 320 forming a flat supporting portion thereof. In counterclockwise rotation of the impeller 10, the tip portion 340 of a rear blade 30*b* protrudes towards a front blade 30*a*.

Figure 3:
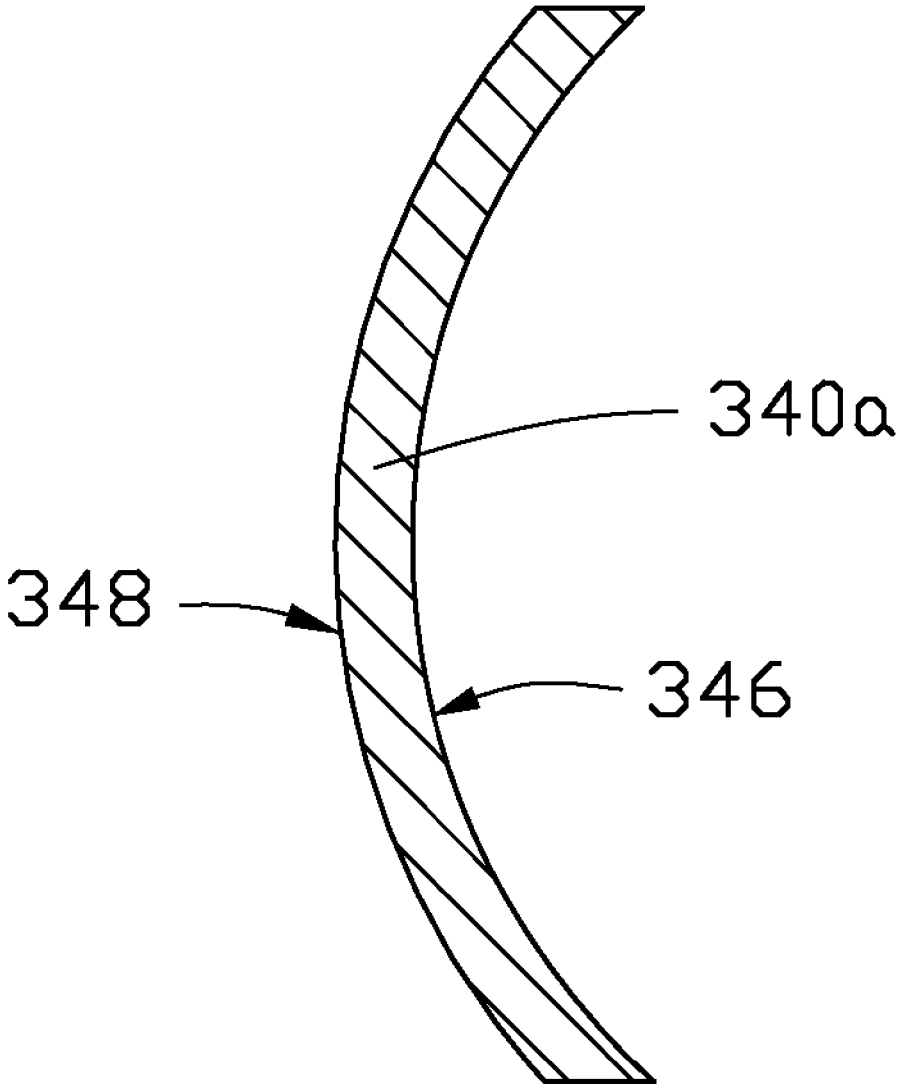
FIG. 3 is a first cross section of a tip portion of a blade of the impeller shown in FIG. 2, along a line III-III.
Figure 4:
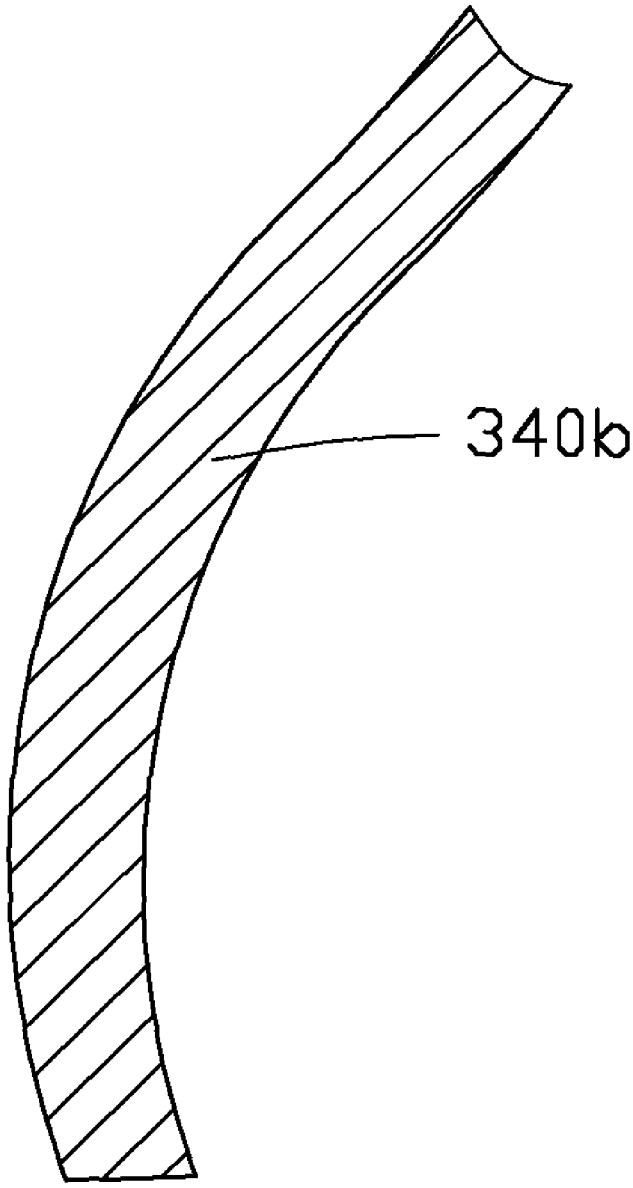
FIG. 4 is a second cross section of the tip portion of the blade of the impeller shown in FIG. 1, along a line IV-IV.

The tip portion 340 of each blade 30 has a concave surface 346 and a convex surface 348 on opposing rear and front sides thereof. Also referring to FIGS. 3-4, the tip portion 340 of each blade 30 has a first curved cross section 340*a* along a transverse axis thereof and a second curved cross section 340*b* along a longitudinal axis thereof. Alternatively, the first, second cross sections 340*a*, 340*b* can be other curved shapes, such as, for example, semicircular. In this case, the concave surface 346 and the convex surface 348 are semispherical surfaces, generating maximum airflow.

The concave surface 346 and the convex surface 348 have a same radian. Alternatively, the concave surface 346 and the convex surface 348 can have differing radians, whereby tip portion 340 of the blade 30 has a varying thickness.

Figure 5:
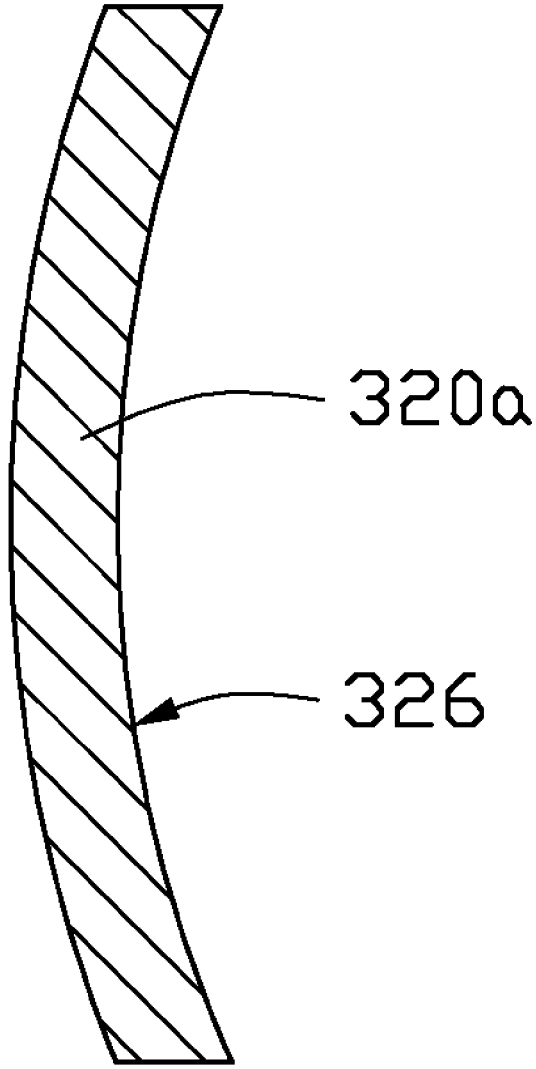
FIG. 5 is a cross section of a root portion of the blade of the impeller shown in FIG. 2, along a line V-V.

Referring to FIG. 5, the root portion 320 of the blade 30 has a curved cross section 320*a* along a transverse axis thereof, such that root portion 320 has a concave surface 326 similar to that of the tip portion 320. The radian of the concave surface 326 of the cross section 320*a* is less than that of the concave surface 346 of the tip portion 340. Accordingly, airflow generated by the blade 30 is further increased. Alternatively, the cross section 320*a* of the root portion 320 of the blade 30 can be flat.

In operation, the impeller 10 rotates counterclockwise so that the concave surfaces 346 of the blades 30 impel air directly to generate airflow. Because the blades 30 having the concave surfaces 346 impel more air by volume than conventional flat blades, airflow generated is greatly increased, as is heat dissipation accordingly.

Figure 6:
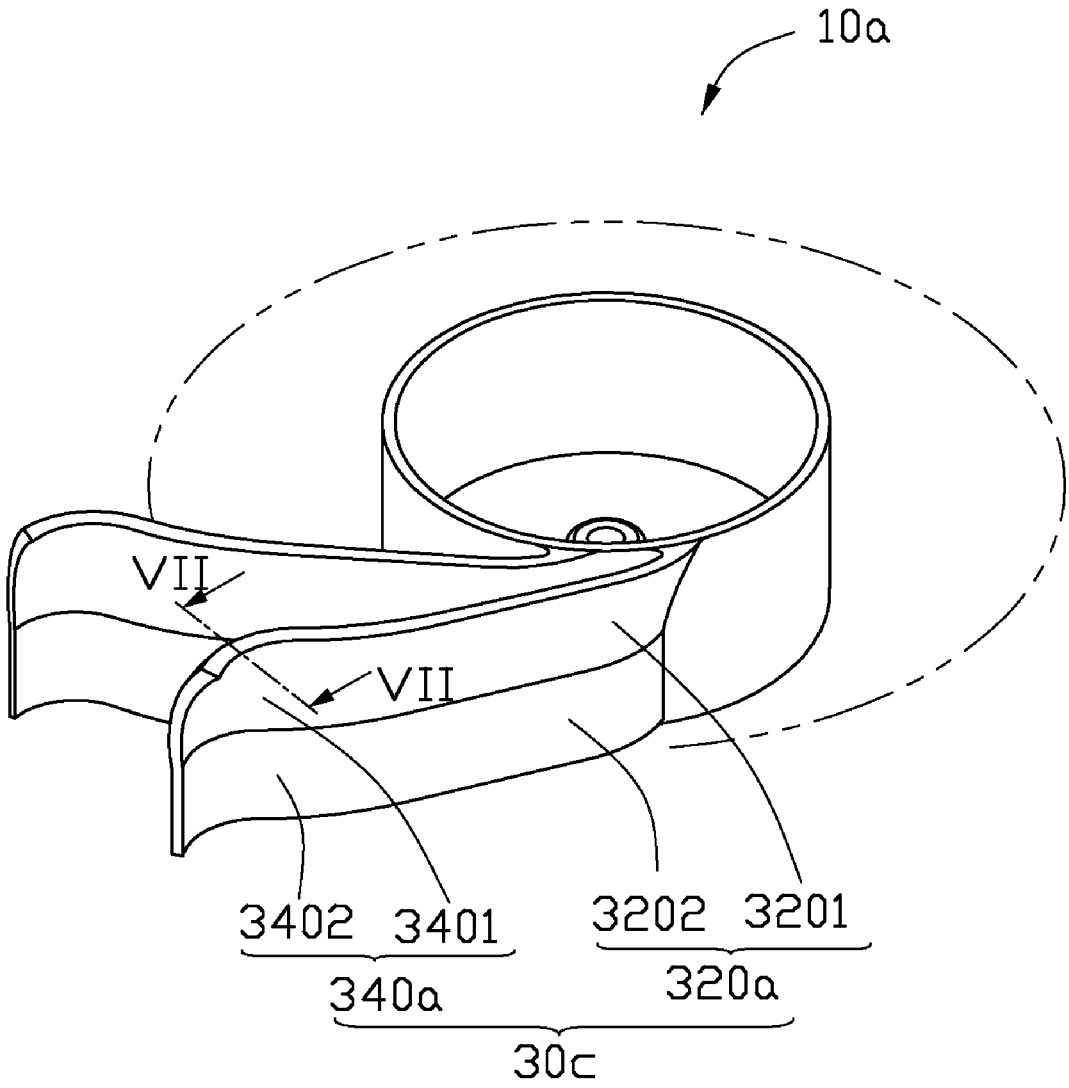
FIG. 6 is an isometric view of the impeller of the centrifugal fan in accordance with a second embodiment, wherein only two blades are shown.
Figure 7:
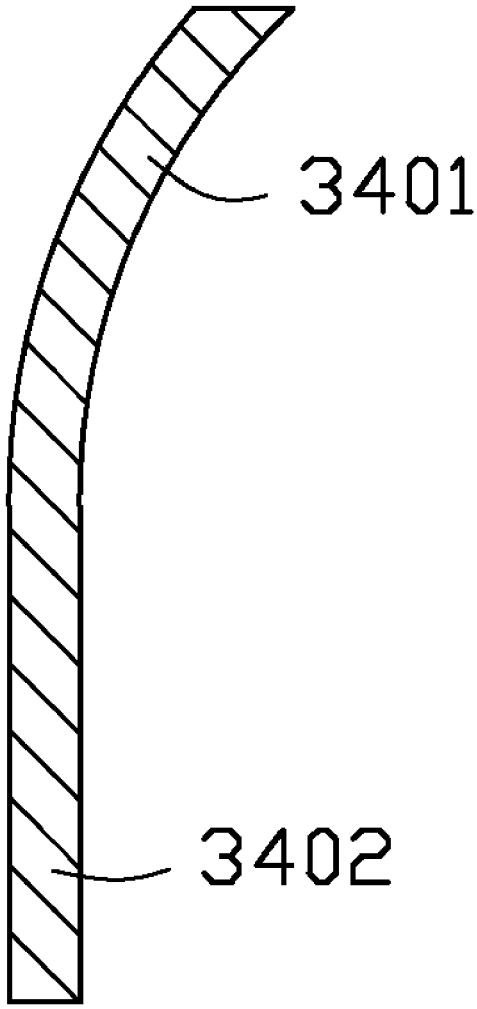
FIG. 7 is a cross section of the tip portion of the blade shown in FIG. 6, along a line VII-VII.

Referring to FIG. 6, an impeller 10*a* according to a second embodiment is shown. The impeller 10*a* has a configuration similar to the impeller 10, differing in that a tip portion 340*a* of a blade 30*c* includes an upper portion 3401 and a lower portion 3402. A root portion 320*a* of the blade 30*c* includes an upper portion 3201 and a lower portion 3202. The upper portions 3401, 3201 are curved along a transverse axis, whereas the lower portions 3402, 3202 are straight along the transverse axis.

It is believed that the disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An impeller of a centrifugal fan, the impeller comprising:

a hub; and a plurality of blades arranged on and around the hub, each of the blades including a root portion and a tip portion, the root portion connecting with the hub and the tip portion forming a free end of the blade, the tip portion and the root portion being curved along a transverse axis of each of the blades of the impeller which is parallel to a rotational axis of the impeller;

wherein each of the tip portion and the root portion comprises a concave surface and a convex surface on rear and front sides thereof respectively, and a radian of the concave surface of the root portion is less than that of the concave surface of the tip portion.

2. The impeller of a centrifugal fan of claim 1, wherein the tip portion is curved along a longitudinal axis thereof.

3. The impeller of a centrifugal fan of claim 2, wherein the tip portion is semispherical.

4. The impeller of a centrifugal fan of claim 1, wherein the tip portion of each of the blades is semicircular along the transverse axis thereof.

5. The impeller of a centrifugal fan of claim 1, wherein the concave surface of the tip portion faces and drives air when the impeller rotates.

6. The impeller of a centrifugal fan of claim 5, wherein along a rotational direction of the impeller, the tip portion of a rear blade protrudes towards a front blade.

7. The impeller of a centrifugal fan of claim 1, wherein the tip portion includes an upper portion and a lower portion, the upper portion is curved and the lower portion is straight.

8. The impeller of a centrifugal fan of claim 7, wherein the root portion includes an upper portion and a lower portion, the upper portion is curved and the lower portion is straight.

9. The impeller of a centrifugal fan of claim 1, wherein the root portion has a extended length longer than the tip portion.

10. The impeller of a centrifugal fan of claim 1, wherein the concave surfaces of the root portion and the tip portion of a rear blade are oriented toward a front blade along a rotation direction of the impeller.

11. An impeller of a centrifugal fan, the impeller comprising:

a hub; and a plurality of blades arranged on and around the hub, each of the blades including a root portion and a tip portion, the tip portion of each of the blades having a concave surface and a convex surface on rear and front sides thereof respectively; and wherein the root portion comprises a concave surface and a convex surface on rear and front sides thereof respectively, and wherein the concave surfaces of the tip portion and the root portion are curved along a transverse axis of each of the blades of the impeller which is parallel to a rotational axis of the impeller, and a radian of the concave surface of root portion is less than that of the concave surface of the tip portion.

12. The impeller of a centrifugal fan of claim 11, wherein the concave surface and the convex surface of the tip portion are semispherical.

13. The impeller of a centrifugal fan of claim 11, wherein the concave surface and the convex surface of the tip portion have the same radian.

14. The impeller of a centrifugal fan of claim 11, wherein the concave surface and the convex surface of the tip portion have different radians, such that the tip portion of each of the blades has a varying thickness.

15. The impeller of a centrifugal fan of claim 11, wherein each of the root portion and the tip portion comprises an upper portion and a lower portion, the upper portion is curved and the lower portion is straight.

16. The impeller of a centrifugal fan of claim 11, wherein the root portion has a extended length longer than the tip portion.

17. The impeller of a centrifugal fan of claim 11, wherein the concave surfaces of the root portion and the tip portion of one of the blades are oriented toward a front blade along a rotation direction of the impeller to face and drive air when the impeller rotates.

* * * * *